US006536142B2

(12) United States Patent
Mizutani et al.

(10) Patent No.: US 6,536,142 B2
(45) Date of Patent: Mar. 25, 2003

(54) EXCAVATOR FOR A DITCH AND EXCAVATING METHOD THEREFOR

(75) Inventors: Motohiko Mizutani, Akashi (JP); Tadao Nakayama, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/875,030

(22) Filed: Jun. 7, 2001

(65) Prior Publication Data

US 2001/0049891 A1 Dec. 13, 2001

(30) Foreign Application Priority Data

Jun. 9, 2000 (JP) ..... 2000-173324

(51) Int. Cl.[7] ..... E02F 3/08
(52) U.S. Cl. ..... 37/352; 37/906; 37/462
(58) Field of Search ..... 37/352, 353, 347, 37/348, 382, 189, 462, 465, 906; 172/2; 701/50; 405/267, 269, 275

(56) References Cited

U.S. PATENT DOCUMENTS

| | | | | |
|---|---|---|---|---|
| 4,379,658 | A | * | 4/1983 | Schmednecht |
| 5,247,743 | A | * | 9/1993 | Holloway et al. |
| 5,249,379 | A | * | 10/1993 | Baker et al. |
| 5,559,725 | A | * | 9/1996 | Nielson et al. |
| 5,572,809 | A | * | 11/1996 | Steenwyk et al. |
| 6,085,445 | A | * | 7/2000 | Kanzler |
| 6,336,077 | B1 | * | 1/2002 | Boucher |
| 6,354,026 | B1 | * | 3/2002 | Trevisani |
| 6,381,882 | B1 | * | 5/2002 | Mizutani et al. |

FOREIGN PATENT DOCUMENTS

| | | | |
|---|---|---|---|
| DE | 198 06 047 | | 9/1998 |
| EP | 0 791 690 | | 8/1997 |
| JP | 56-105030 | * | 8/1981 |
| JP | 10-317870 | * | 12/1998 |
| JP | 11-93202 | | 4/1999 |

OTHER PUBLICATIONS

Patent Abstracts of Japan, JP 2001–003383, Jan. 9, 2001.
Patent Abstracts of Japan, JP 07–048838, Feb. 21, 1995.
Patent Abstracts of Japan, JP 06–108456, Apr. 19, 1994.
Patent Abstracts of Japan, JP 11–200403, Jul. 27, 1999.
U.S. patent application Ser. No. 09/468,909, Docket No. 0023–1748–3X, filed Dec. 22, 1999, Status Allowed.
U.S. patent application Ser. No. 09/875,030, Docket No. 209335US2X*, filed Jun. 7, 2001, Status Pending.
U.S. patent application Ser. No. 10/026,685, Docket No. 217640US2X, Status Pending.

* cited by examiner

*Primary Examiner*—Victor Batson
(74) *Attorney, Agent, or Firm*—Oblon, Spivak, McClelland, Maier & Neustadt, P.C.

(57) ABSTRACT

An excavator of the invention comprises an excavating body having an excavating element and a clinometer detecting an inclination angle of ditch wall in a excavating ditch; a traveling distance recorder for measuring moving distance of said excavator; a calculator for calculating and accumulating the inclination signal for every moving distance of said excavator on the basis of the inclination signal outputted from said clinometer and the moving distance signal outputted from the traveling distance recorder; and a display device for displaying accumulated said inclination signal outputted from said calculator, thereby can excavate the ditch with excellent flatness of the ditch wall.

8 Claims, 8 Drawing Sheets

EXCAVATOR FOR A DITCH AND EXCAVATING METHOD THEREFOR

BACKGROUND OF THE INVENTION

1. Field of the Invention

The present invention relates to an excavator for excavating a ditch under the ground and a method for excavating a ditch.

2. Description of the Related Art

There are works for excavating a ditch under the ground in basic civil engineering work. And, there was a problem regarding a flatness of ditch wall of ditch as excavating the ditch.

An example to object an improvement of the flatness is disclosed in Japanese Patent Application Laid-Open No. hei 11-93202. Hereinafter, the conventional excavator is explained by the case of excavating the underground ditch vertical to the ground, referring to FIG. 5 showing a front view of the excavator, FIG. 6*a* showing a status connecting a underground clinometer to a connection rod, FIG. 6*b* showing a cross-sectional plan view of a cutter post included in a ditch excavating body, FIG. 7 showing a block diagram of the clinometers and data processing means respectively, and FIG. 8 showing an example of a display screen.

An excavator 1 comprises an excavating device main body 2 consisting of a traveling body 2*a* and a revolving body 2*b* disposed on the traveling body 2*a*. The revolving body 2*b* is equipped with a gate-shaped frame 3. The frame 3 is supported with a leader 4 being slide in the approximately horizontal direction by a slide cylinder 4*a*. The leader 4 is installed to a rotation-driving device 7 ascended and descended by an oil pressure cylinder, and the driving device 7 is installed to a driving sprocket 6*b* driving in clockwise and counterclockwise.

A housing bottom end of said device 7 is connected with a cutter post 6*a* having a plurality of elements, and in the bottom end, a driven sprocket 6*c* is installed. Also, an excavating body 6 is formed with an endless-typed excavating chain 6*d* installed between said driving and driven sprockets. The excavating chain 6*d* equipped with an excavating blade or an excavating edge 6*e* is driven together with the driving and the driven sprockets, then, the excavating body 6 is moved to the transverse direction in the underground to excavate a ditch 100.

Underground clinometers 11–14 are disposed on said cutter post 6*a*, a ground clinometer 15 is disposed on the traveling body 2*a*. The underground clinometers, as shown in FIG. 6*a*, consist a clinometers assembly connecting up and down through a connecting rod 16, a length scale of each connecting rod 16 becomes a spaced scale between the underground clinometers. An electric wire 17 connecting them electrically is wired along said connecting rod 16.

On the other hand, as shown in FIG. 6*b*, the cutter post 6*a* is formed with not only a supply hole 18 of air, etc., extended to the up and down directions (the depth direction in FIG. 6*b*), but also a clinometer insert hole 19, parallel to the supply hole, and in the inset hole 19, the clinometers assembly is inserted, as shown in FIG. 6*a*.

A data processing means 40 as shown in FIG. 7 is disposed on an operating chamber 2*c* of said revolving body 2*b*. The data processing means 40 consists of a data logger 41 and a personal computer 42 (hereinafter referred to as PC). Said data logger 41 is connected with the underground and the ground clinometers 11–15 through the electric wire 17, and inputs an output analogue signal of the clinometers respectively. Said PC 42 calculates an inclination or a bent status of the cutter post 6*a* from a data recorded in the data logger 41 to display it on a monitor screen every moment.

A display screen of said PC 42 is explained referring to FIG. 8. The display screen is displayed with a depth factor numerical value 51, a bent curve 52 of the cutter post 6*a*, inclination angles 53A, 53B of inner surface direction and outer surface direction in predetermined depth, and bent amounts 54A, 54B and so on of the cutter post 6*a* to the inner surface direction and outer surface direction. With this, the current inclination status or bent status of the cutter post 6*a* can be known.

However, said conventional excavator can measure an inclination or a displacement of ditch wall only in a hole unit rather than the whole ditch wall. And it does not have a function to process an inclination data of the whole ditch wall in real time.

In order to excavate a ditch having high precision ditch wall with more excellent verticality under the ground, it is necessary to obtain not only the inclination of ditch wall in the present position of excavating body but also the whole shape of the ditch wall (history of inclination). However, in the conventional excavator, it is difficult to excavate the ditch with the ditch wall of high precision because it cannot comprehend the whole shape of ditch wall.

SUMMARY OF THE INVENTION

It is therefore an object of the present invention to provide an excavator for a ditch and an excavating method capable of excavating the ditch having the ditch wall of high precision with more excellent flatness by comprehending the whole shape of the ditch wall.

The excavator of the invention comprises as follows:

- an excavating body having an excavating element and a clinometer for detecting an inclination angle of ditch wall of excavated ditch;
- a traveling distance recorder for measuring a moving distance of the excavator;
- a calculator for calculating and accumulating an inclination signal of every moving distance of said excavator on the basis of the inclination signal outputted from said clinometer and a moving distance signal outputted from said traveling distance recorder; and
- a display device for displaying said inclination signal accumulated outputted from said calculator.

In this case, an operator can operate the excavator recognizing the whole shape of ditch wall shape changed every moment by a monitor because accumulated inclination signal, for example, is displayed as a ditch wall shape on the monitor. Accordingly, it is possible to excavate the ditch with high precision flatness of the ditch wall.

DETAILED DESCRIPTION OF THE PREFERRED EMBODIMENTS

Hereinafter, an excavator for a ditch according to an embodiment of the present invention will be described with reference to FIGS. 1 to 4. However, the invention should not be limited by the embodiment.

Figure 1:
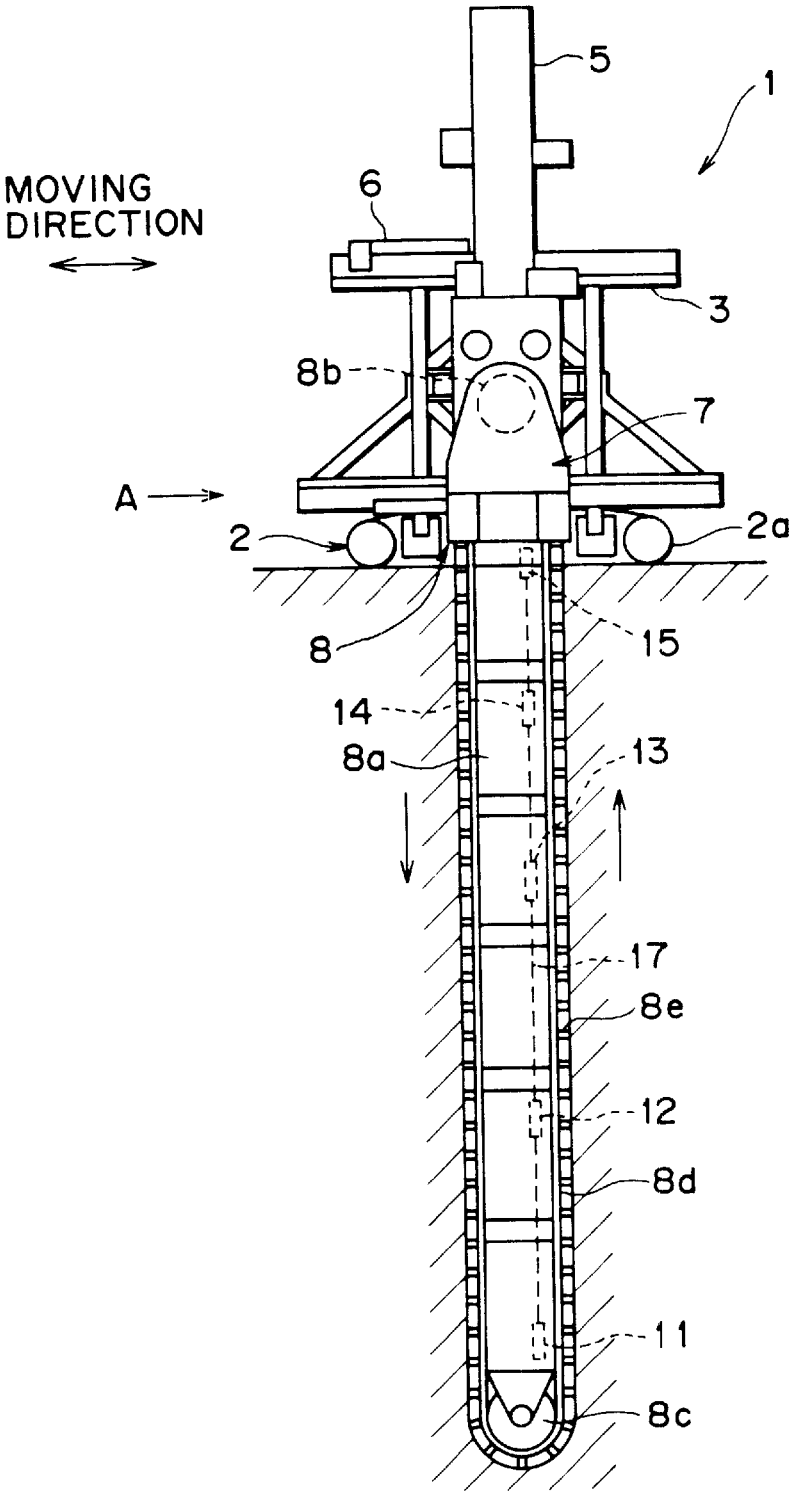
FIG. 1 is a schematic front view of an excavator for a ditch according to an embodiment of the invention.
Figure 2:
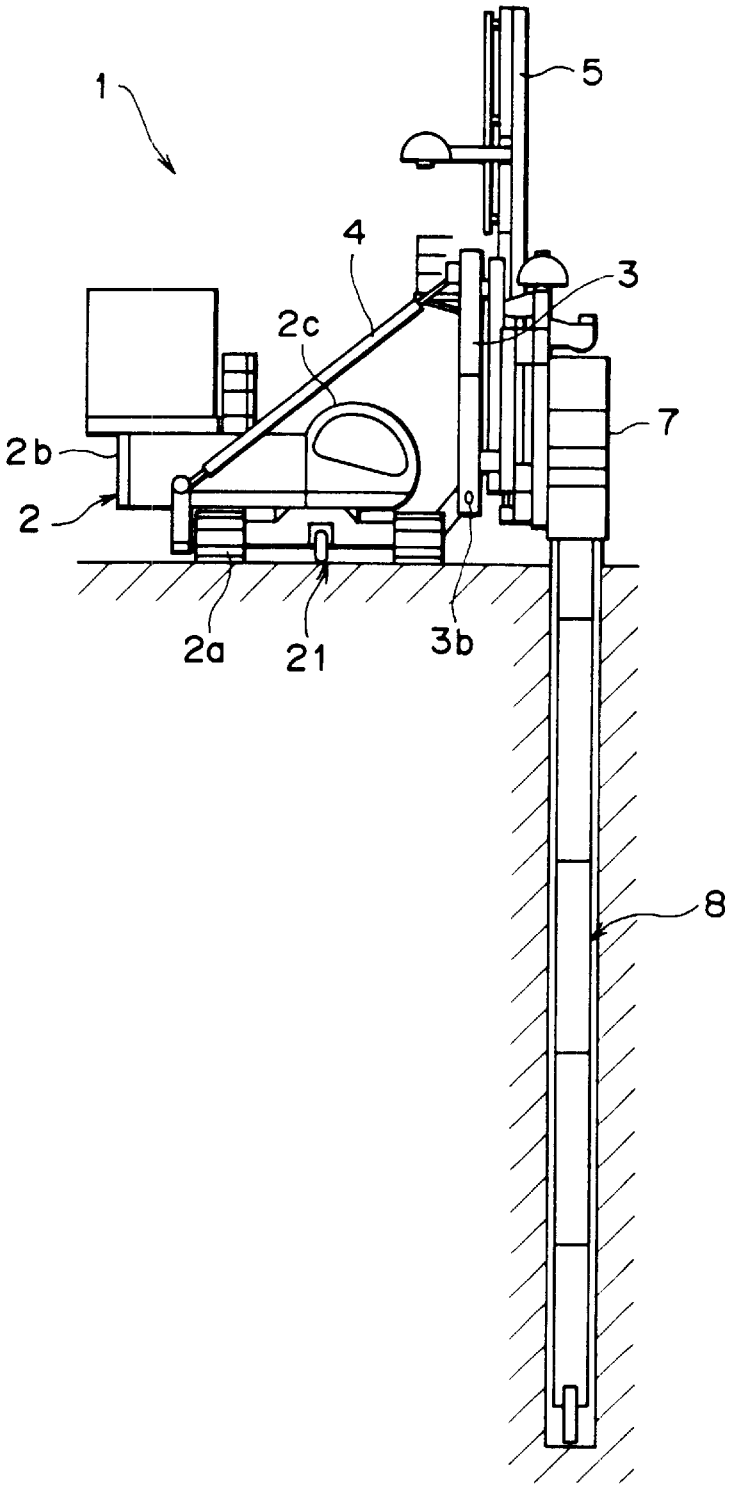
FIG. 2 shows as viewed in arrow A direction shown in FIG. 1.
Figure 3:
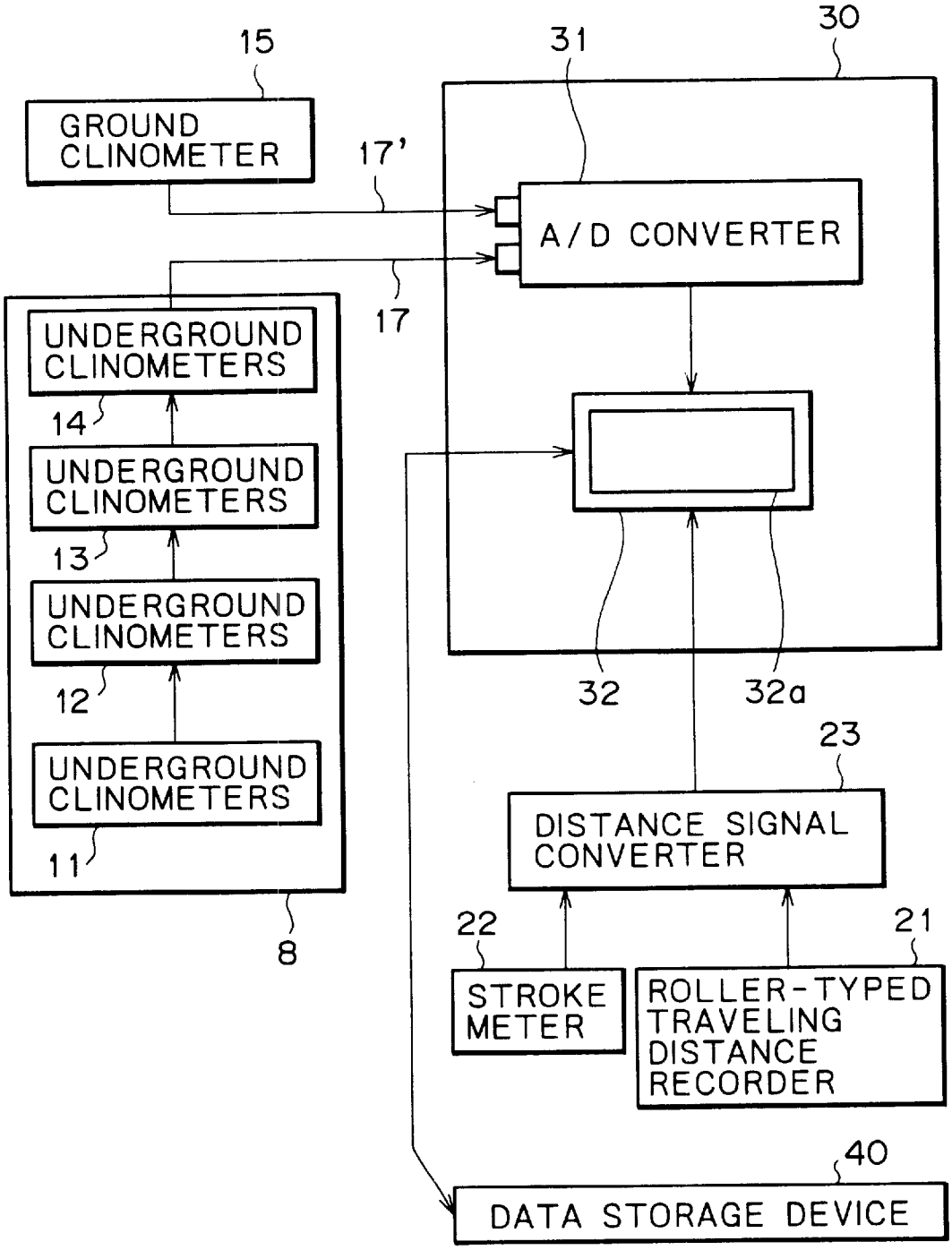
FIG. 3 is a block diagram of a ditch wall shape display device according to the embodiment of the invention.
Figure 4:
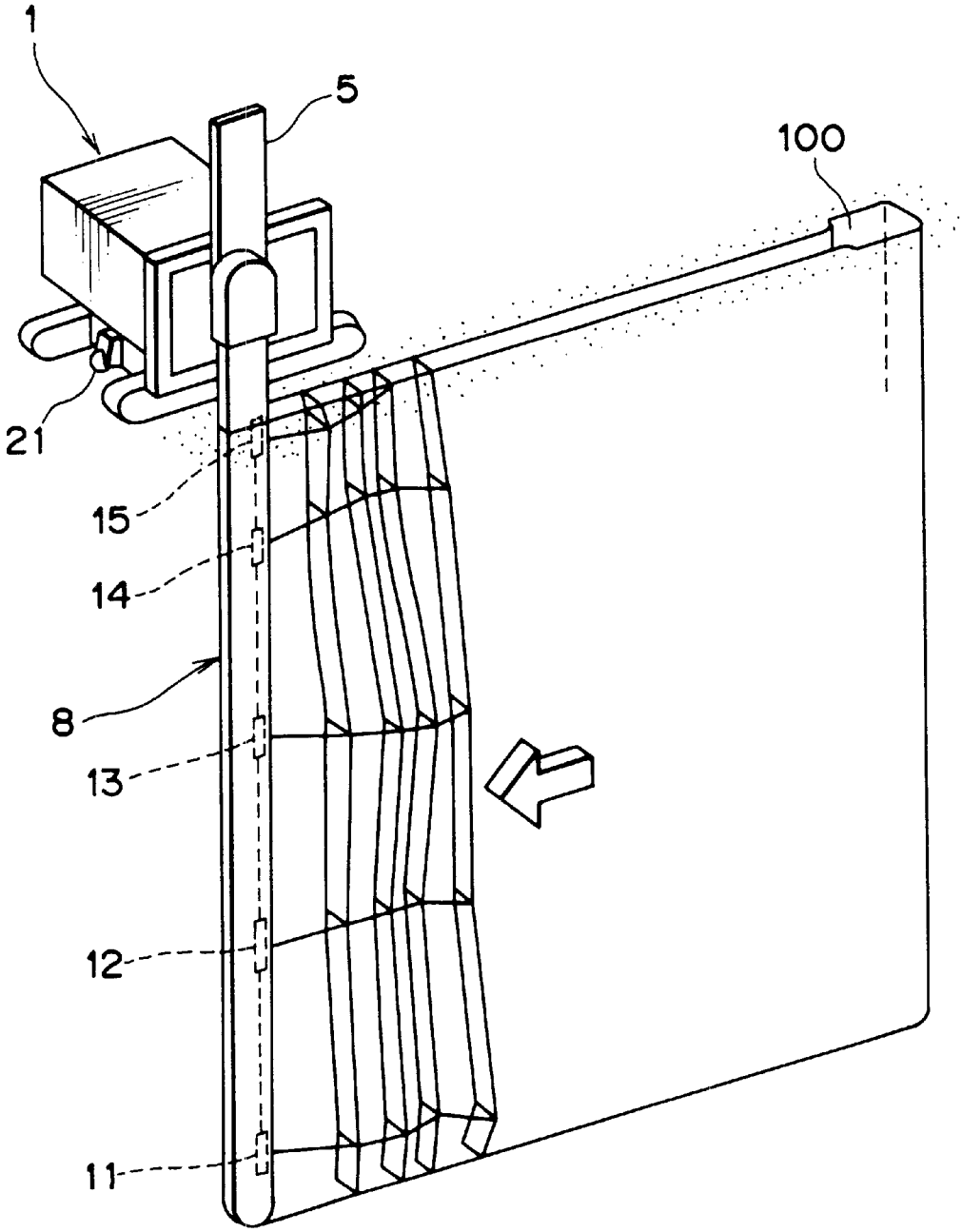
FIG. 4 is an image diagram of ditch wall display according to the embodiment of the invention.
Figure 5:
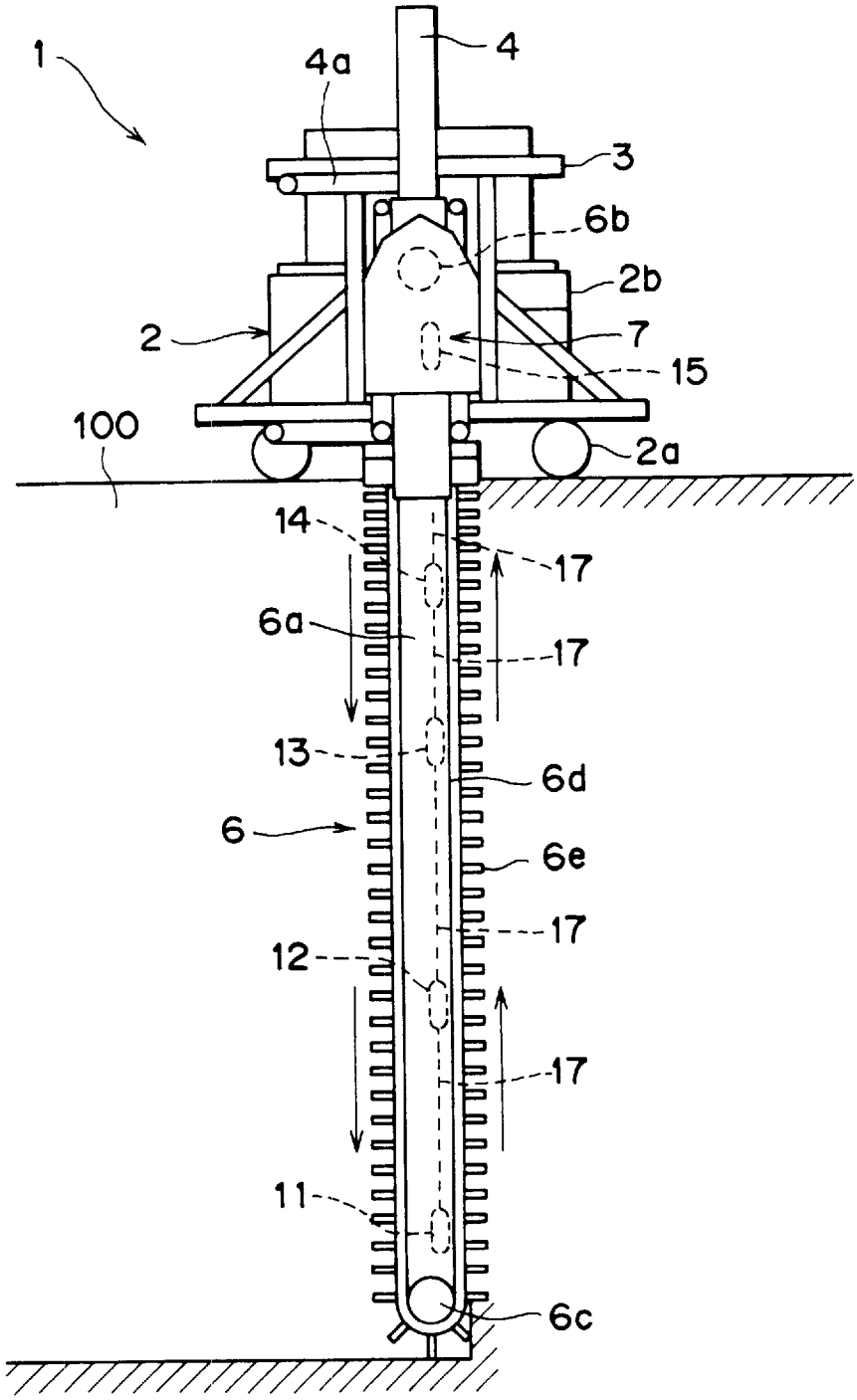
FIG. 5 PRIOR ART
FIG. 5 is a schematic front view of an excavator of the prior art.
Figure 6A:
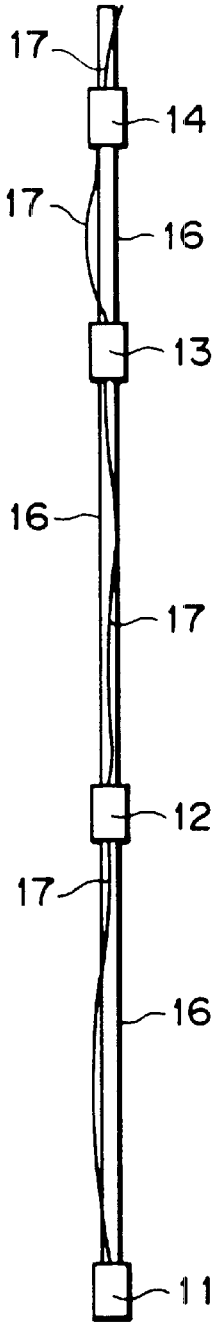
FIG. 6a PRIOR ART
FIG. 6*a* shows, as the prior art, a status connecting underground clinometers with a connecting rod.
Figure 6B:
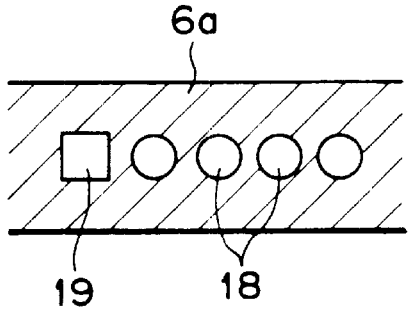
FIG. 6b PRIOR ART
FIG. 6*b* is a cross-sectional plan view of a cutter post comprising an excavating body.
Figure 7:
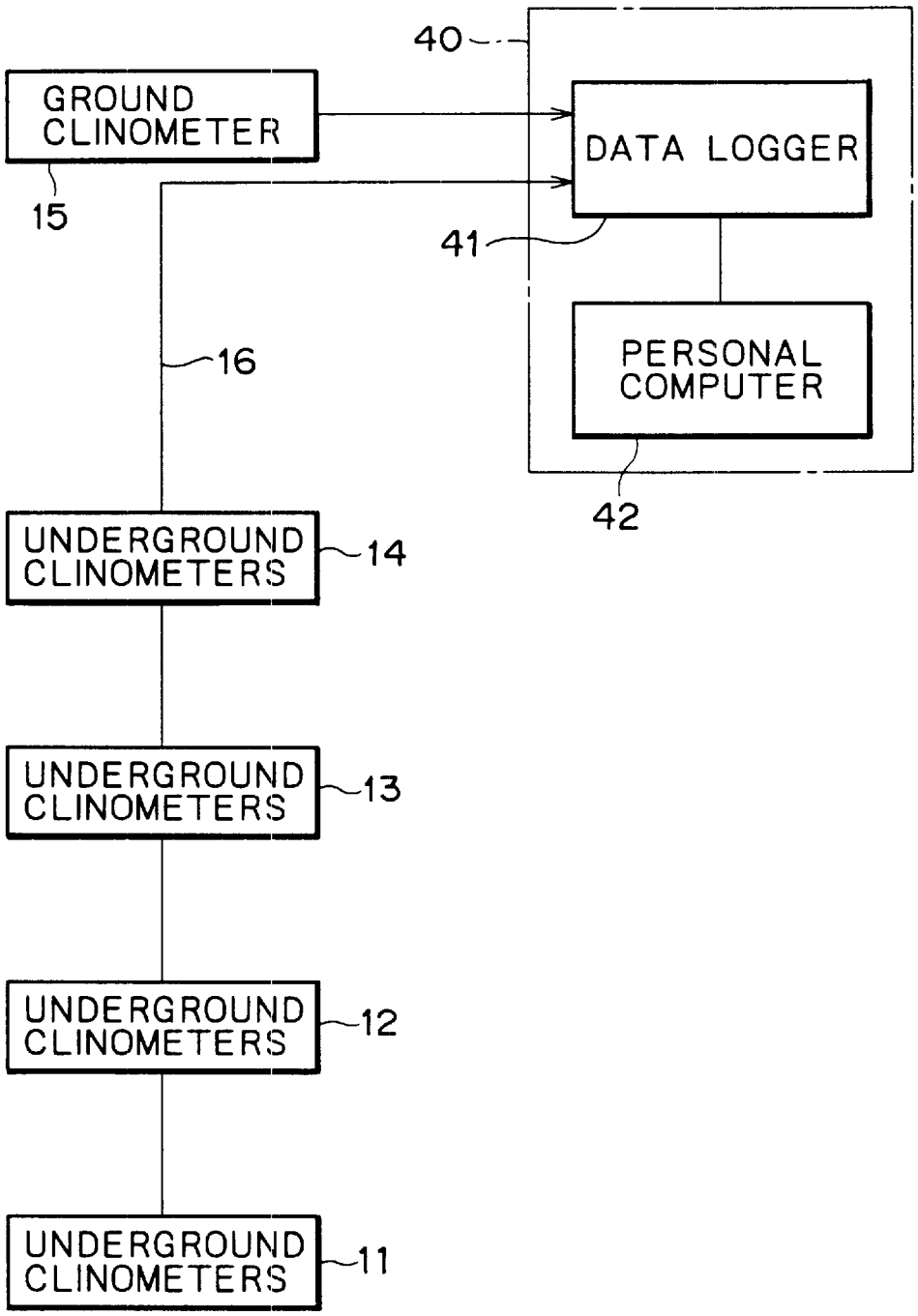
FIG. 7 PRIOR ART
FIG. 7 is, as the prior art, a block diagram of clinometers respectively and a data processing means.
Figure 8:
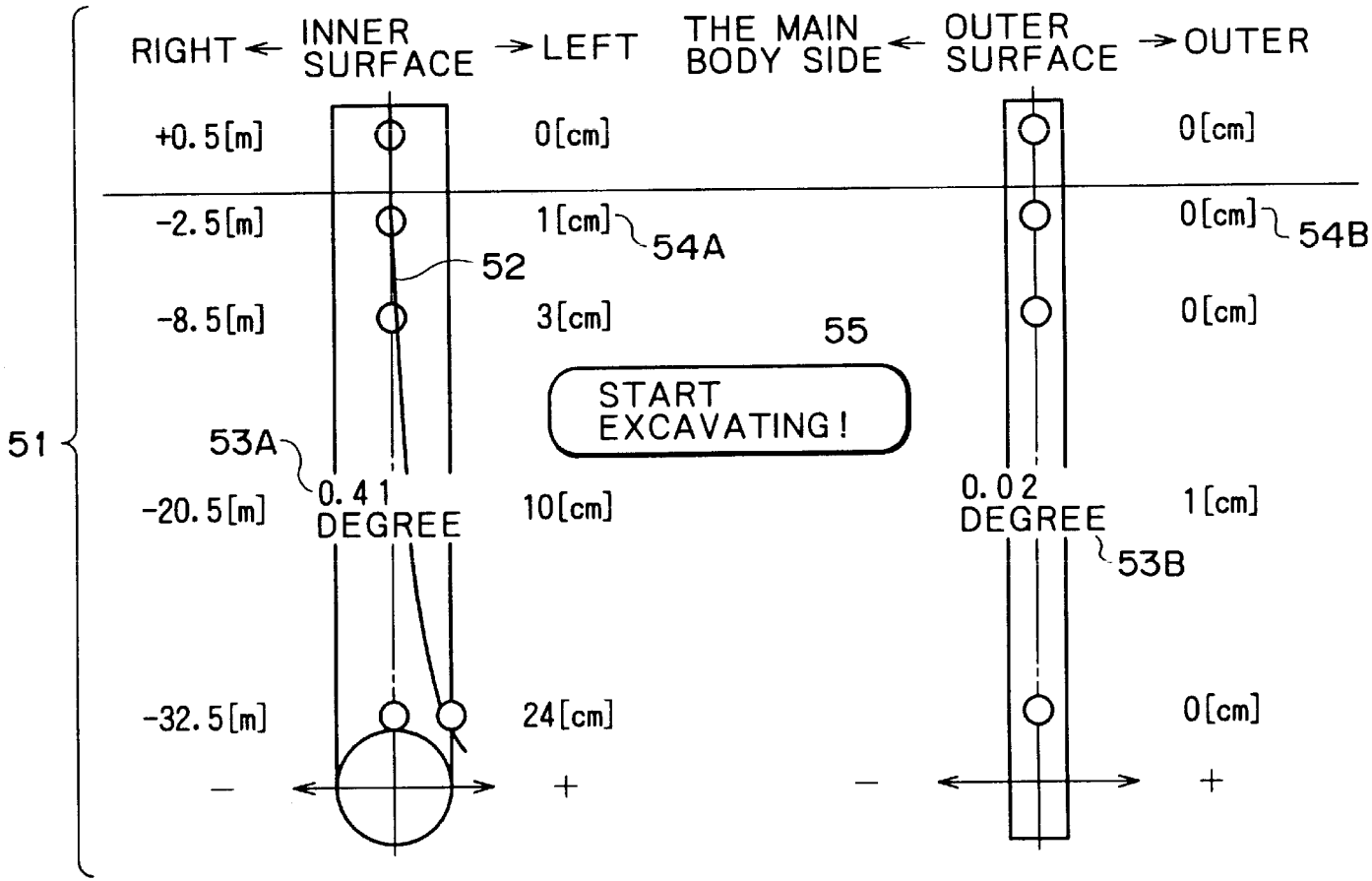
FIG. 8 PRIOR ART
FIG. 8 shows an example of screen displayed by the data processing means, as prior art.

FIG. 1 is a schematic front view of an excavator according to the embodiment of the present invention. FIG. 2 shows as viewed in arrow A direction shown in FIG. 1. FIG. 3 is a block diagram of a display device for ditch wall shape. FIG. 4 is an image view of ditch wall display. Hereinafter, the case of excavating the underground ditch vertical to the ground will be described as an example with reference to these FIGS. However, among the major constituents of the excavator according to the present embodiment is explained with the same names as the excavator of the prior art as long as having the same construction and function between both excavators.

A numerical number 1 as shown in FIGS. 1 and 2 is an excavator for a ditch. The excavator 1 is provided with an excavating device main body 2 consisting of a traveling body 2*a* for traveling on the ground surface and a revolving body 2*b* disposed on the traveling body 2*a*. The revolving body 2*b* of the main body 2 is equipped with a gate-shaped frame 3 to be rotated a support point pin 3*b* as a support point of rotation, parallel to the moving direction of the main body 2 by a stay cylinder 4. The frame 3 is supported with a leader 5 which slides and drives reciprocatingly in the approximately horizontal direction (horizontal direction parallel to the ground) by a slide cylinder 6.

The leader 5 is equipped with a rotation-driving device 7 ascended and descended by an oil pressure cylinder as not shown. The rotation-driving device 7 is installed with a self-driving sprocket 8*b*. The driving sprocket 8*b* is driven by the device 7 in either clockwise or counterclockwise. A stroke length of rod in said slide cylinder 6 is measured by a stroke meter 22 (referring to FIG. 3) so as to input to a display device for a ditch wall shape as described later.

A housing bottom end of said device 7 is connected with a cutter post 8*a* expanded to a lower side. The cutter post 8*a* includes a plurality of elements connected up and down. A bottom end of the cutter post 8*a* is installed to a driven sprocket 8*c* which rotates freely. Also, an endless-typed excavating chain 8*d* is installed between said sprocket 8*b* and said sprocket 8*c*, thereby an excavating body 8 is formed. An excavating body frame which supports rotatably the driving and the driven sprockets 8*b* and 8*c* is formed by a housing of the rotation-driving device 7 and the cutter post 8*a*.

A surface of said excavating chain 8*d* is equipped with a plurality of excavating blades 8*e*. As the excavating chain 8*d* is driven together with the driving and driven sprockets 8*b* and 8*c*, the excavating body 8 is moved horizontally in the underground, thereby it is possible to excavate a ditch 100 in the progress direction.

And, in said cutter post 8*a*, a plurality (four in case of the embodiment) of underground clinometers 11, 12, 13 and 14 as lining up to the up and down directions is disposed. In addition to that, a ground clinometer 15 is disposed on the traveling body 2*a*. The clinometers 11 to 15 detect an inclination angle of the ground surface, namely, the ditch wall contacted to the clinometers respectively as the traveling body 2*a* travels. As the clinometers 11 to 15, an inclination angle sensor, for example, a deformation gauge type sensor, potentiometer type sensor, electrostatic capacity type sensor, etc can be used.

The lowest or deepest underground clinometer among said underground clinometers 11 to 14 is disposed on the nearly bottom end position of the cutter post 8*a*. The underground clinometers 12, 13 and 14 are disposed towards the ground with proper intervals in order from the deepest underground clinometer 11.

And, each clinometer 11 to 15 may detect an inclination angle parallel to the moving direction of the excavating body 8 (left and right directions in FIG. 1; hereinafter referred to as ([inner surface direction]). Also, they may detect an inclination angle vertical to the moving direction of the excavating body 8 (depth direction in FIG. 1; hereinafter referred to as [outer surface direction]).

In the present embodiment, the clinometers 11 to 15 have a function to detect inclination angles of the inner surface direction parallel to the moving direction of the excavating body 8, and the outer surface direction vertical to the moving direction of the excavating body 8 at the same time substantially. An analogue inclination signal of ditch wall measured by the clinometers 11 to 15 are inputted to the ditch wall shape display device as described later.

However, there are the effects derived from measuring the inner surface direction and outer surface direction of the excavating body 8 almost simultaneously. That is, by the measured result of the inner surface direction of the clinometers 11 to 15, it can be known that the cutter post 8*a* is pressured into the harder ground more harder among the excavating cross-sections of the ditch wall during the excavation. Thereby, it is possible to select more effective excavating method. Also, it is helpful to know the bent amount of the cutter post 8*a* quantitatively generated by the horizontal thrust force of the slide cylinder 6. And, the measured result of the outer surface direction becomes necessary information to manage the shape of ditch wall precisely. In the present embodiment, because it can obtain the measured results of both the inner and outer surface directions almost simultaneously, it can excavate efficiently the ditch having the high precise ditch wall with excellent flatness.

A distance recorder 21, as described later, is installed in the excavator 1 of the embodiment. The distance recorder 21 comprises a wheel for rolling on the ground surface, an encoder for measuring the horizontal moving distance of said excavator main body 2 by rotation of the wheel, a chain for transmitting the rotation of said wheel to the encoder, a case-shaped bracket installed with said encoder and at the same time, supports rotatably said wheel, and a rotating arm projected from the case-shaped bracket, and mounted rotatably on a mounting bracket mounted to the excavator main body 2 for rolling the wheel toward and away from the ground surface. And, the horizontal moving distance signal of the excavator main body 2 measured by the distance recorder 21 is inputted to the ditch wall shape display device as described later.

Using said distance recorder 21, it can measure the horizontal moving distance signal of the excavator main body 2 without providing special supplementary equipment at the outside position of the excavator 1. Accordingly, it is ease to prepare the work to measure the moving distance of the excavator 1.

However, in case of the recorder 21, the accumulated errors due to continuous measure of the horizontal moving distance signal of the excavator main body 2 occurs. Thus, it is necessary to correct the errors or to amend the accumulated errors every day. Also, the reason to adopt a repellant type that the wheel of the recorder 21 rolls to contact the ground surface and separate from the ground is because in case of moving only within a construction site, it is unnecessary to measure the horizontal moving distance of the excavator main body 2.

However, the excavator 1 of the present embodiment employs the traveling distance recorder 21 having a wheel and an encoder for measuring the horizontal moving distance from the rotation of the wheel. But, besides that, it can employ an automatic tracking system or GPS position measuring system.

The former is a system equipping a prism target in the excavator main body 2 and disposing an automatic tracking range finder at the outer side of the excavator 1. The automatic range finder measures a three-dimensional position of the prism target from a distance and an angle to the prism target.

The latter is a system equipping the excavator main body 2 with a GPS antenna, disposing the GPS antenna (reference station) on outside position of the excavator 1, and at the same time, receiving a signal from a GPS satellite through the GPS antenna (reference station), then measuring a position of said GPS antenna. Thereby, it can measure three-dimension motion of the excavator main body 2 in high precision.

In accordance with employing these systems, it can measure the horizontal moving distance of the excavator main body 2 in most high precision.

An operating cabin 2*c* mounted on said revolving body 2*b* is equipped with the ditch wall shape display device 30 which inputs and displays following signal and the like. That is an analogue inclination signal of the ditch wall measured by the clinometers 11 to 15 respectively, the rod stroke length of the slide cylinder 6 measured by a stroke meter 22, and the horizontal moving distance signal of the excavator main body 2 measured by said traveling distance recorder 21.

The ditch wall shape display device 30 comprises an A/D converter 31 and a personal computer 32 (hereinafter referred to as PC) as a calculator having a monitor 32*a*.

In the A/D converter 31, the underground clinometers 11 to 14 are connected through an electric wire 17. Also, the ground clinometer 15 is connected through an electric wire 17' to said A/ID converter 31. The analogue inclination signal of the ditch wall inputted from the clinometers 11 to 15 is converted into a digital inclination signal by the A/D converter 31, then, inputted to the PC 32. In addition, in the PC 32, following signal is inputted side by side with input of said digital inclination signal. That is, an analogue traveling distance signal of the excavator main body 2 measured by the traveling distance recorder 21 and an analogue stroke length signal of telescopic rod of the slide cylinder 6 measured by the stroke meter 22 respectively are digital converted by the distance signal converter (A/D converter), then inputted as a digital stroke length signal.

Said PC 32 processes said digital inclination signal as the inclination data of the ditch wall in three-dimension for every horizontal moving distance of the excavating body 8 corresponding to the sampling time which was set up in advance. In accordance with that, the PC 32 accumulates the inclination data obtained by the three-dimension processing in the transverse direction. And the inclination data accumulated in the transverse direction is displayed as a transverse wall shape of the excavated ditch on the monitor 32*a* in real time. Also, the inclination data accumulated in the transverse direction is stored in a data storage device 40. In accordance with that, the inclination data, if necessary, is inputted to the PC 32 and redisplayed on the monitor 32*a*. With this, the operator can recognize the whole ditch wall shape changed every moment. Also, after completing the excavation, it can confirm if the whole ditch wall shape is in good shape or not. Also, in the embodiment, though the PC 32 is integrally comprised with the monitor 32*a*, it can be separated.

The excavator 1 of the present embodiment, as described in the above, can display the ditch wall shape under excavation or the ditch wall shape provided in advance on the monitor 32*a*. Also, said PC 32 may be connected with a printer (not shown). In this case, it is possible to display the ditch wall shape by the monitor 32 as well as to print by the printer. Also, in the excavator 1 of the present embodiment, four underground clinometers 11 to 14 are embedded on the cutter post 8*a*. Of course, the underground clinometer may be one, or may be 5 or more. The present invention is not limited to the laid number of the underground clinometers. Hereinafter is explained the case of construction that only one clinometer is embedded in the cutter post 8*a* of the excavating body 8. The PC 32 is provided with the function to estimate and calculate not only the depth of ditch corresponding to the installed position of said underground clinometers through a stiffness and a bent curve of the cutter post 8*a* of the excavating body 8, but also the ditch wall shape of the depth, and the ditch wall shape from an optional depth factor.

The case of excavating the ditch under the ground by the excavator 1 will be explained as follows:

1) First, the excavator 1 is fixed to the objective position determined in advance.
2) The excavating chain 8*d* drives in the direction of raking up the soil and inserts the excavating body 8 under the ground.
3) As the excavating body 8 reaches at a predetermined depth, for example the rod of slide cylinder 6 expands in a state of driving the excavating chain 8*d*. Thereby, the excavating body 8*d* is horizontally moved in the transverse direction parallel to the ground surface together with the leader 5 so as to excavate the ditch having length corresponding to the rod stroke length of said slide cylinder 6.
4) Then, the excavator main body 2 is moved to the excavating direction adapting a reduction operation of rod of the slide cylinder 6.
5) With this, after fixing at the predetermined position, the excavating chain 8*d* drives in the direction of raking up the soil, for example the rod of slide cylinder 6 is expanded and operated. Thereby, the excavating body 8 is horizontally moved to the transverse direction parallel to the ground surface together with the leader 5.
6) The above steps repeat for excavating a long ditch under the ground.

This kind of excavating works in the underground, an inclination of ditch depth direction of the underground parts of the excavating body 8 is measured by the underground clinometers 11 to 14 laid on the cutter post 8*a*. The measured analogue inclination signal is inputted to the A/D converter 31. And, the analogue inclination signal is converted into a digital inclination signal by A/D converter 31 and inputted to the PC 32. Also, the analogue horizontal moving distance signal of the excavating body 8 measured by the traveling distance recorder 21 and the stroke meter 23 are converted by a distance signal converter 23, and inputted as a digital horizontal moving distance signal along with the input of the digital inclination signal.

Also, in the present embodiment, two distance finders of the traveling distance recorder 21 and the stroke meter 22 are used. As described in the above, this is the reason that it employs an excavating method which excavates the ditch by means of repetition of the horizontal moving of the excavating body 8 by the rod expand operation of the slide cylinder 6 and the horizontal moving by self-traveling of the excavator 1 after the slide cylinder 6 becomes a stroke end.

The digital inclination signal from A/D converter 31 and the digital horizontal moving distance signal from the distance signal converter 32 are inputted to the PC 32. Then, the PC 32 accumulates the inclination data of the ditch wall to the transverse direction, in which said digital inclination signal is obtained for every horizontal moving distance of the excavating body 8 corresponding to the sampling time determined in advance through the three-dimension processing.

In this way, as shown in FIG. 4, the accumulated inclination data is displayed as the inclination of the ditch wall for every horizontal moving distances corresponding to the sampling time determined in advance from the initial excavation to the pending excavation. In other words, it is displayed on the monitor 32*a* in a real time as the ditch wall shape of the whole ditch from the initial excavation to the pending excavation. Accordingly, the operator can operate the excavator 1 recognizing the whole ditch wall shape changed every moment and excavate the ditch in the underground. Namely, it is possible to operate the excavator 1 to become the flatness of the ditch wall in high precision.

Also, after completing a series of the excavating works is completed, the inclination data of the ditch wall accumulated in the transverse direction from the data storage device 40 is inputted to the PC 32. At the same time, it is checked whether the flatness of the whole ditch wall shape is in good shape or not by means of displaying the inputted inclination data as the ditch wall shape on the monitor 32*a*, or it is checked whether the flatness is in good shape or not by printing the ditch wall shape by the printer.

And, if it is necessary to correct the ditch wall shape, the next work will be started after the excavator 1 is turned back to the excavating initial position. That is, on the basis of the ditch wall shape displayed on the monitor 32*a* or the printed ditch wall shape, as inclining the excavating body 8 to the center direction or the outer direction of the excavator main body 2 and moving in the transverse direction while pressing the excavating body 8 to the ditch wall, the inclined surface of the ditch wall completed the excavation is trimmed. Thereby, it is possible to excavate the high precise ditch having the ditch wall with more excellent flatness.

Of course, when correcting the ditch wall shape, as same as excavating the ditch under the ground, the horizontal moving of the excavating body 8 by expand operation on the rod of slide cylinder 6, and the horizontal moving such as moving in itself of the excavator 1 after the slide cylinder 6 becomes to be a stroke end are repeated.

As mentioned above, in case of the construction providing one underground clinometer which is embedded in the cutter post 8*a*, the PC 32 is provided with the functions to estimate and calculate the ditch wall shape of the depth other than the depth of the ditch corresponding to the installed position of said underground clinometers through the stiffness and the bent curve of the excavating body 8, hence, the post 8*a*, and derive the ditch wall shape at an optional depth factor. In case of the depth of ditch is 10 m, it has been made to a comparison test between the construction providing four underground clinometers which is laid in the cutter post 8*a* according to the embodiment and the construction of providing one underground clinometer. As a result, it is confirmed that the difference of the flatness of the ditch wall for both is 2 cm and the construction providing the case of underground clinometer is laid in the cutter post 8*a* can be used for the practical use. In this case, the cost of the excavator can be reduced because of shortening the number of the clinometers.

The excavator 1 explained in the above embodiment with the case of excavating the underground ditch vertical to the ground. However, the excavator 1 can excavate the inclined ditch by operating to shorten the rod of the stay cylinder 4 and moving the excavating body 8 with an inclined state at a predetermined range of angle. Accordingly, the technical idea of the present invention is not applied only to the vertical excavation.

Further, the technical scope of the present invention is not limited by the embodiment.

We claim:

1. An excavator for a ditch comprising:

an excavating body having an excavating element and a clinometer for detecting an inclination angle of a ditch wall of an excavated ditch;

a traveling distance recorder for measuring a horizontal moving distance of said excavator;

a calculator for calculating and accumulating a signal for the inclination angle along the moving distance of said excavator on the basis of a signal output from said clinometer and a signal for the moving distance signal output from said traveling distance recorder; and a display device for displaying said signal for the inclination angle accumulated output from said calculator.

2. An excavator according to claim 1, wherein said clinometer measures inclination angles substantially parallel to a moving direction of said excavating body and inclination angle s substantially vertical to the moving direction of said excavating body.

3. An excavator according to claim 1, wherein said display device displays said inclination signal as a ditch wall shape.

4. An excavator for a ditch comprising:

an excavating body having an excavating element and a clinometer for detecting an inclination angle of a ditch wall of an excavated ditch;

a traveling distance recorder for measuring a moving distance of said excavator;

a calculator for calculating and accumulating a signal for the inclination angle along the moving distance of said excavator on the basis of a signal output from said clinometer and a signal for the moving distance signal output from said traveling distance recorder; and a display device for displaying said signal for the inclination angle accumulated output from said calculator, wherein said excavating element is an excavating element having an endless-typed excavating blade.

5. An excavator for a ditch comprising:

an excavating body having an excavating element and a clinometer for detecting an inclination angle of a ditch wall of an excavated ditch;

a traveling distance recorder for measuring a moving distance of said excavator;

a calculator for calculating and accumulating a signal for the inclination angle along the moving distance of said excavator on the basis of a signal output from said clinometer and a signal for the moving distance signal output from said traveling distance recorder; and a display device for displaying said signal for the inclination angle accumulated output from said calculator, wherein a ditch wall shape in depth other than the depth corresponding to an installed position of said clinometer is calculated from a stiffness and a bent curve of said excavating body, and the ditch wall shape at optional depth factor is derived.

6. An excavating method for a ditch comprising the steps of:

calculating an inclination signal including an inclination angle for a depth direction of a ditch of an excavating body and a signal for a horizontal moving distance of said excavating body as the ditch is excavated by driving the excavating body having an excavating element;

accumulating the inclination signal along the moving distance of said excavating body on a basis of said inclination signal and said signal for the moving distance;

displaying said inclination signal accumulated as a ditch wall shape on a monitor; and executing a ditch excavation according to said ditch wall shape.

7. An excavating method for a ditch comprising the steps of:

calculating an inclination signal including an inclination angle for a depth direction of a ditch of an excavating body and a signal for a moving distance of said excavating body as the ditch is excavated br driving the excavating body having an excavating element;

accumulating the inclination signal along the moving distance of said excavating body on a basis of said inclination signal and said signal for the moving distance;

displaying said inclination signal accumulated as a ditch wall shape on a monitor;

executing a ditch excavation according to said ditch wall shape; and trimming an inclined surface of a ditch wall by pressing said excavating body into the ditch wall by means of controlling the inclination angle of said excavating body on the basis of said ditch wall shape displayed.

8. An excavator for a ditch, comprising:

an excavating body having at least one clinometer embedded therein for detecting an inclination angle under the ground in a transverse direction;

an A/D converter for converting an analogue inclination signal output from the clinometer into a digital inclination signal;

a traveling distance recorder for measuring a horizontal moving distance of the excavating body;

a calculator for receiving the digital inclination signal outputted from said A/D converter and a moving distance signal outputted from said traveling distance recorder, and accumulating an inclination data, which is produced by processing in three-dimension a horizontal moving trace of said excavating body in the horizontal direction; and a ditch wall shape display device including a monitor displaying the inclination data accumulated output from the calculator as a shape of the ditch wall in real time.

* * * * *